US005979961A

United States Patent [19]

Carey

[11] Patent Number: 5,979,961

[45] Date of Patent: Nov. 9, 1999

[54] TUBE BUNDLE LIFTING DEVICE

[75] Inventor: H. B. Carey, Edmonton, Ky.

[73] Assignee: Carey Consulting, Inc., Edmonton, Ky.

[21] Appl. No.: 09/013,378

[22] Filed: Jan. 26, 1998

[51] Int. Cl.[6] ..... B66C 1/62

[52] U.S. Cl. ..... 294/110.2; 294/118

[58] Field of Search ..... 294/110.1, 110.2, 294/81.61, 67.31, 113, 118

[56] References Cited

U.S. PATENT DOCUMENTS

| | | | |
|---|---|---|---|
| 1,506,827 | 9/1924 | Gellert | 294/110.2 |
| 1,839,389 | 1/1932 | Heppenstall | 294/110.2 |
| 2,890,906 | 6/1959 | Jacquart | 294/110.1 |
| 3,155,416 | 11/1964 | Buchik et al. | 294/110.1 |
| 3,508,780 | 4/1970 | Bartman | 294/110.1 |

FOREIGN PATENT DOCUMENTS

| | | | |
|---|---|---|---|
| 52-20554 | 2/1977 | Japan | 294/110.2 |
| 52-31450 | 3/1977 | Japan | 294/110.2 |
| 54-129642 | 10/1979 | Japan | 294/110.1 |

OTHER PUBLICATIONS

Photocopies (Exhibits A and B) of a prior art lifting device manufactured by the Heppen–Stal Company of Pittsburgh, Pennslyvania on or about 1955.

*Primary Examiner*—Dean Kramer

*Attorney, Agent, or Firm*—Carrithers Law Office; David W. Carrithers

[57] ABSTRACT

A frame having upper and lower longitudinal frame members supports pairs of pivotally connected holding arms having curved "J-shaped" distal ends and curved blades mounted thereinbetween. Latch arms pivotally connect to one another on one end and to a short upper frame member and a short lower frame member of the longitudinal frame members support a cylindrical cam latch and lock assembly mounted onto the upper latch arm. A travel pin moves up and down within a predetermined channel or groove formed in a split cylindrical bushing and rotates in a predetermined pattern to simultaneously rotate and move a locking dog and a wedge shaped plunger extending downwardly therefrom up and down and in for cooperative engagement with a slot or keyhole formed in the lower latch arm thereby engaging or disengaging the "J-shaped" holding arms. The cylindrical cam mechanism is activated by lifting and/or lowering the tube bundle lifting unit onto the ground thereby causing the travel pin, locking dog, and plunger to rotate to preselected positions to lock or unlock the holding arms. Dropping the open holding arms on the ground releases tension on and activates the cylindrical cam locking mechanism so that upon raising the lifting arms they close around the tube bundle. Upon lowering and lifting the tube bundle lifting device to the ground takes the tension off of the cylindrical cam locking mechanism so that the cam assembly holds the arms in the open position to be removed from the tube bundle.

15 Claims, 4 Drawing Sheets

TUBE BUNDLE LIFTING DEVICE

BACKGROUND OF THE INVENTION

One of the biggest problems in the petrochemical industry is bundles being damaged by contractors during shut downs by using cables and straps on the bundles to move them, or by using conventional tong lifting devices which tend to damage the tubes which come in contact with the cable or tong.

The industry desires a means to cut labor and cost in handling bundles whether loading them in a truck or moving them around the work yard, into the shop, around the cleaning pad, loading and unloading trucks, or for putting bundles into the shells.

The bundle lifting device of the present invention is the safest way to lift a tube bundle without any damage to the tube bundle. Once a bundle has been picked up, it is impossible for it to come out until it has been sit down and the weight relieved, releasing the tube bundle. The lifting device is maintenance free. The present invention may be used in combination with conventional lift trucks or fork lifts to move a 18 to 25 ton tube bundle in a matter of minutes. Other devices which are delicate and heavy such as, U-tube bundles, pillbox bundles, floating head type bundles, or even distillation columns may be carried with the present invention.

SUMMARY OF THE INVENTION

A tube bundle lifting device for use in the chemical industry for moving large tube bundles around a building or work area. The tube bundle device may be supported by heavy equipment such as a fork truck or crane.

A frame including an upper longitudinal frame member such as a steel beam supports a lifting assembly including at least two pair of "J-shaped" lifting arms extending downward from each end in alignment with one another and have opposing curved distal ends portions. The pair of "J-shaped" lifting arms are pivotally connected at their center to a lower longitudinal frame support member extending thereinbetween and in alignment with the upper longitudinal frame support member. The proximate ends of each of the "J-shaped" lifting arms are pivotally connected to the distal end of a pair of upper lifting arms each of which is pivotally connected to a pivot point extending from the distal end of the upper longitudinal frame support member. Opposing curved blades are mounted on the inner surface of the curved distal ends of the "J-shaped" lifting arms for providing a large surface area for holding tube bundles thereinbetween.

A locking latch assembly consists of a pair of latch arms, defining an upper latch arm and a lower latch arm, pivotally connected to one another at the distal ends for pivotal movement up and down in the Y-axis. The upper latch arm is pivotally connected near its distal end to a short upper center support arm extending downward from the upper longitudinal frame support member. The lower latch arm is pivotally connected near its distal end to a short lower support arm extending upward from the a central point of the lower longitudinal frame support member.

A cylindrical cam locking and latch assembly is mounted to the distal end of the upper latch arm includes a locking dog and wedge shaped plunger for cooperative engagement with a slot or keyway formed in the distal end of the lower latch arm. The cylindrical cam locking and latch assembly provides a means for automatically opening and closing the lifting arms around a tube bundle without requiring the driver to leave the lift truck or the use of hydraulic cylinders or cables connected to a power unit. Dropping the open lifting arms on the ground releases tension on and activates the cylindrical cam locking mechanism so that upon raising the lifting arms they close around the tube bundle. Upon lowering the lifting arms and tube bundle to the ground taking the tension off of the cylindrical cam locking mechanism, whereby the cam holds the arms in the open position to be removed from the tube bundle.

The cylindrical cam locking assembly consist of three parts: a bushing with grooves which is split along the center line at 0 degrees and 180 degrees; a housing that holds the bushing; and a locking dog with pin inserted on the top center line for traveling the grooves in the bushing. Inside the bushing are twelve grooves, eight grooves in the top half and four grooves in the bottom half. The four grooves in the bottom half are milled on the vertical center lines at the 1, 90, 180, and 270 degree lines. The bottom grooves are milled at 0.125 thousands "off set" making the dog travel in one direction only. The top eight grooves are milled on a 45 degree angle intersecting the four bottom grooves allowing the locking dog to rotate the full 360 degrees with up and down motions. The bottom grooves are milled "off set" which makes the locking dog travel in one direction only.

The locking dog consists of a movable cylinder coaxially disposed within a cylindrical cam coaxially and immovably retained within a housing attached to the upper arm of the lifting assembly. A shaft extending downwardly from the cylinder includes distal end defining a wedge shaped plunger which extends downwardly therefrom for cooperative engagement with a slot or "keyway" formed in the lower arm of the lifting assembly.

The cylindrical cam locking mechanism works as follows: With the fork lift suspending the tube bundle lifting device the traveling pin and locking dog are in the locked "up" position so that the traveling pin supporting the plunger is located at the bottom of the groove and the distal ends of the pin are supported by the flange extending around the periphery of the bottom of the housing of the upper arm. The upper surface of the plunger extending through the keyway is oriented normal to the keyway and therefor lifts the lower arm and the blades in a selected position either a "partially open" or "open", locked "up" position, after release of a tube bundle.

Upon lowering the blades onto the ground the traveling pin rotates an additional 45 degrees and travels downward at an angle within the channels or grooves formed in the interior surface of the cylindrical locking cam. The locking dog and plunger simultaneously extend downward and rotate an additional 45 degrees. Lifting of the frame and lifting assembly with the fork lift tines rotates the traveling pin and locking dog an additional 45 degrees upward to the "up" unlocked position wherein the plunger is in alignment with and can extend through the keyhole permitting the scissoring action of the arms and closing the blades around an object to be lifted.

To release the tube bundle, the tube bundle lifting device is lowered until the blades touch the ground taking the pressure off of the cam locking mechanism. The travel pin rotates and slides downwardly along the channel of the bushing and the locking dog rotates and additional 45 degrees. Upon lifting the tube bundle lifting device upward the travel pin rotates and slides upwardly along the channel within the bushing and the locking dog and plunger again rotate 45 degrees in a locked "up" position normal to the keyway.

Therefore, assuming the locking dog is in the locked position meaning the traveling pin and locking dog are rotated at 45 degrees at the top of the bushing channel and the locking dog is in the "up" position. The next time the top frame is lifted up, the traveling pin and locking dog will rotate and drop down 45 degrees. Upon lifting the top frame, the locking dog will rotate and move to the top of the channel at 90 degrees in misalignment with the keyhole to lift the lifter in the opened position for moving to the next job. When the lifter is lowered, the travel pin and locking dog rotate 45 degrees which unlocks the locking dog from the keyhole. The next time the frame is lifted "up", the travel pin and locking dog rotate and drop 45 degrees aligning the unlocking dog with the keyhole and unlocking the dog 100 percent allowing the lifter to close around the tube bundle.

It is an object of the present invention to provide a means to lift heavy tube bundle type objects whereby the weight is distribute evenly over a large surface area by utilizing curve blades mounted to the lever arms of the lifting device.

It is another object of the present invention to provide an engaging and disengaging mechanism comprising a cylindrical cam assembly in order that the driver of the lift truck may lift, hold, release, and disengage a large tube bundle without having to leave the lift truck.

It is yet another object of the present invention to provide a novel cam mechanism utilizing a split bushing having channels formed on the interior surface thereof to guide a travel pin in rotational and upward and downward movement in a preset pattern to control the opening and closing of the unit.

DETAILED DESCRIPTION OF THE INVENTION

Figure 3:
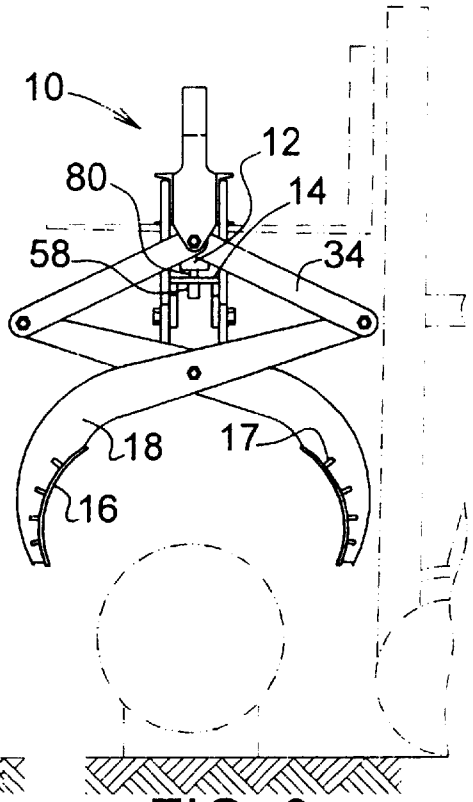
FIG. 3 is a side view of FIG. 2 showing the tube bundle lifting device suspended above a bundle by the tines of a fork lift, wherein the tube bundle and fork lift are shown in phantom lines.
Figure 2:
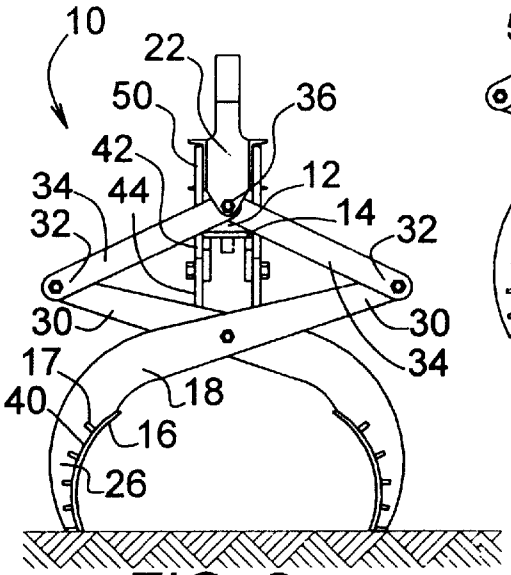
FIG. 2 is a side view of FIG. 1 showing the blades, lifting assembly arms, and cam locking assembly wherein the locking dog and plunger of the cam locking assembly is rotated 90 degrees.

The present invention will now be described with reference to the drawing FIGS. 1–11.

A tube bundle lifting device 10 is fabricated from metal such as steel or iron. The present invention utilizes the novel features of a cylindrical cam mechanism 12 in the lock and latch assembly 14 and blades 16 attached to the lifting arms 18 or tongs of the tube bundle holding device 10. Either the cylindrical cam mechanism 12 or blades 16 may be utilized with other embodiments of the present invention as well as conventional lifting devices.

Figure 4:
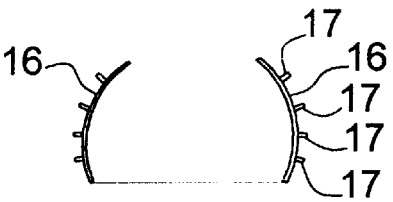
FIG. 4 is side view of the blades showing the degree of curvature varies slightly inwardly from the tip of the blades.
Figure 1:
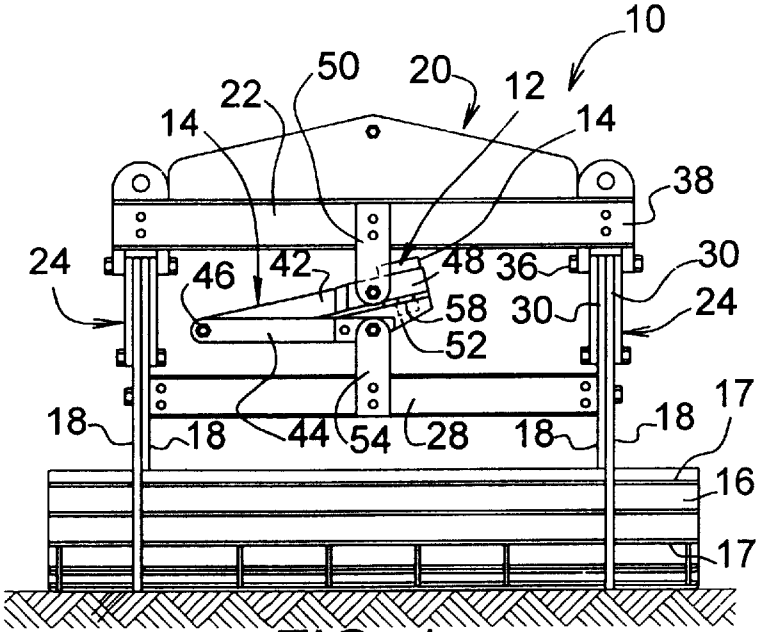
FIG. 1 is a front view of the present tube bundle lifting device showing the blade lifting assembly, tube bundle holding blades, and the cam locking assembly in the open position.
Figure 6:
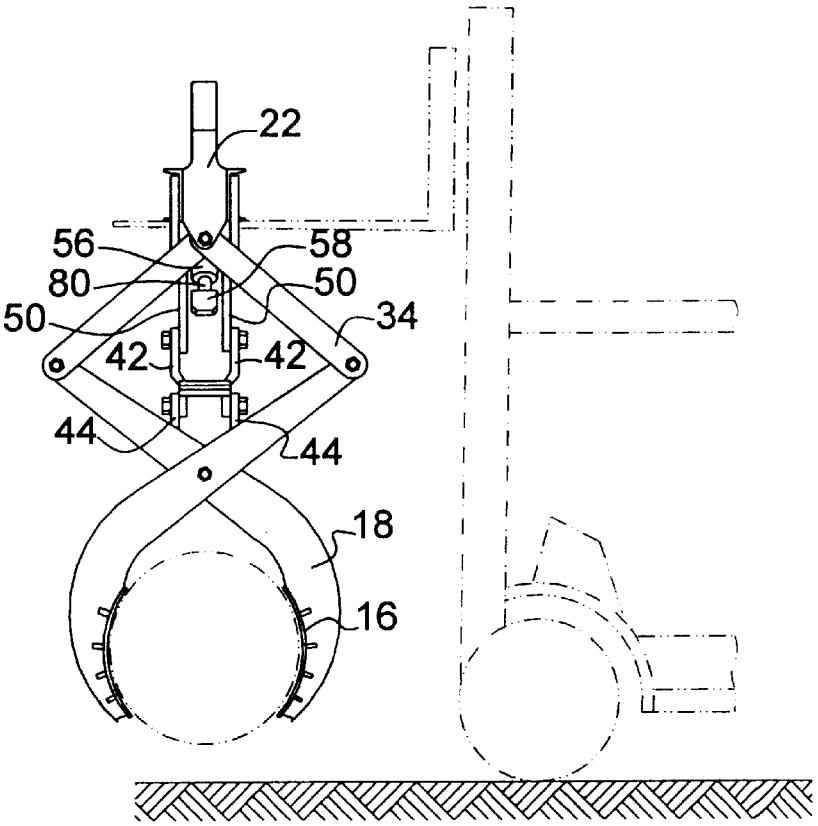
FIG. 6 is shows the tube bundle lifting assembly holding a tube bundle shown in phantom lines being suspended above the ground by the tines of a fork lift shown in phantom lines.
Figure 5:
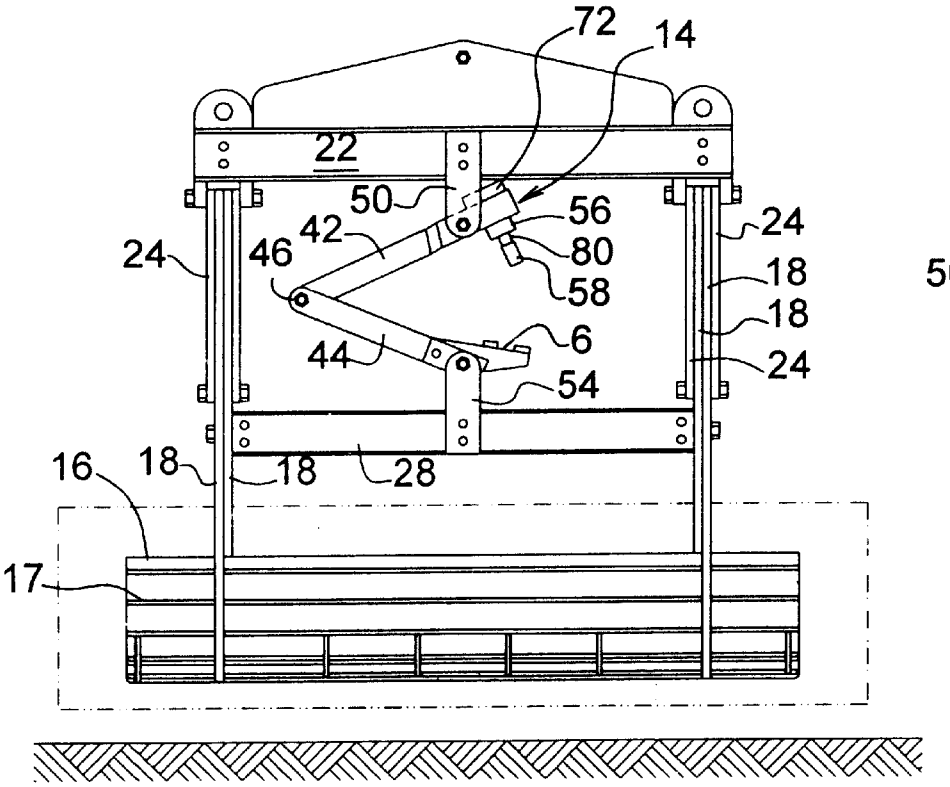
FIG. 5 is a front view of the tube bundle lifting device of FIG. 1, wherein the locking dog of the lifting assembly is separated from the lower arms and latch of the lifting assembly frame and the blades are wrapped securely around the sides of the tube bundle shown in phantom lines.

As best shown in FIGS. 1–6 of the preferred embodiment, a frame 20 including an upper longitudinal frame member 22 such as a steel beam supports a lifting assembly 24 including at least two pair of "J-shaped" lifting arms 26 extending downward from each end in alignment with one another and have opposing curved distal ends portions. The pair of "J-shaped lifting arms 18 are pivotally connected at their center to a lower longitudinal frame support member 28 extending thereinbetween and in alignment with the upper longitudinal frame support member 22. The proximate ends 30 of each of the "J-shaped" lifting arms 18 are pivotally connected to the distal end 32 of a pair of upper lifting arms 34 each of which is pivotally connected to a pivot point 36 extending from the distal end of the upper longitudinal frame support member 22. Opposing curved blades 16 are mounted on the inner surface 40 of the curved "J-shaped portion 26 of the "J-shaped lifting arms 18 for providing a large surface area for holding tube bundles thereinbetween. FIG. 4 shows with particularity that in the preferred embodiment the curvature of the blades decreases near the top allowing the blades to scoop under and provide the maximum amount of surface area to hold delicate tube bundles so as not to damage the tubes during lifting and transporting. Moreover, a plurality of ribs 17 extend outward on the exterior side of the blades 16 to provide additional structural strength and rigidity to the blades while minimizing the weight of the blade.

A locking latch assembly 14 consists of a pair of latch arms, defining an upper latch arm 42 and a lower latch arm 44, pivotally connected to one another at the distal ends 46 for pivotal movement up and down in the Y-axis. The upper latch arm 42 is pivotally connected near its opposing free distal end 48 to a short upper center support arm 50 extending downward from the upper longitudinal frame support member 22. The lower latch arm 44 is pivotally connected near its free distal end 52 to a short lower support arm 54 extending upward from a central point of the lower longitudinal frame support member 28.

As illustrated in FIGS. 7–11, a cylindrical cam locking and latch assembly 12 is mounted to the distal end 48 of the upper latch arm 42. The cylindrical cam locking and latch assembly 12 includes a cylindrical member defining a locking dog 56 and wedge shaped plunger 58 for cooperative engagement with a slot or keyway 6 formed in the distal end 52 of the lower latch arm 44. The cylindrical cam locking and latch assembly 12 operates to provide a means for automatically opening and closing the lifting arms 18 around a tube bundle without requiring the driver to leave the lift truck or the use of hydraulic cylinders or cables connected to a power unit. Dropping the open lifting arms 18 on the ground releases tension on and activates the cylindrical cam locking mechanism 12 so that upon raising the lifting arms 18 they close around the tube bundle. Upon lowering the lifting arms 18 and tube bundle to the ground taking the tension off of the cylindrical cam locking mechanism 12, the plunger 58 holds the arms 18 in the wide open position to be lifted away from the tube bundle.

The cylindrical cam locking assembly 12 consist of three main parts: a bushing 60, more particularly a split bushing having a first side 62 and a second side 64 is machined to have a plurality of channels or grooves 66 which is split along the center line 68 at 0 degrees and 180 degrees; a cylindrical housing 70 having a flange 72 extending around the periphery at the top that holds the bushing 60; and a locking dog 56 with a travel pin 74 inserted on the top center line for traveling the grooves 66 machined into the bushing.

More particularly, inside the bushing 60 are twelve grooves 66, eight grooves 76 in the top half and four grooves 78 in the bottom half. The four grooves 78 in the bottom half are milled on the vertical center lines at the 1, 90, 180, and 270 degree lines. The bottom grooves 78 are milled at 0.125 thousands "off set" making the dog 56 travel in one direction only. The top eight grooves 76 are milled on a 45 degree angle intersecting the four bottom grooves 78 allowing the locking dog 56 to rotate the full 360 degrees with up and down motions. The bottom grooves 78 are milled "off set" which makes the travel pin 74 and locking dog 56 travel in one direction only. The bushing 60 of the preferred embodiment is split into two pieces; however, it is contemplated that the bushing may be split into three or more parts or formed by a molding or casting process from a single piece of material.

Figure 7:
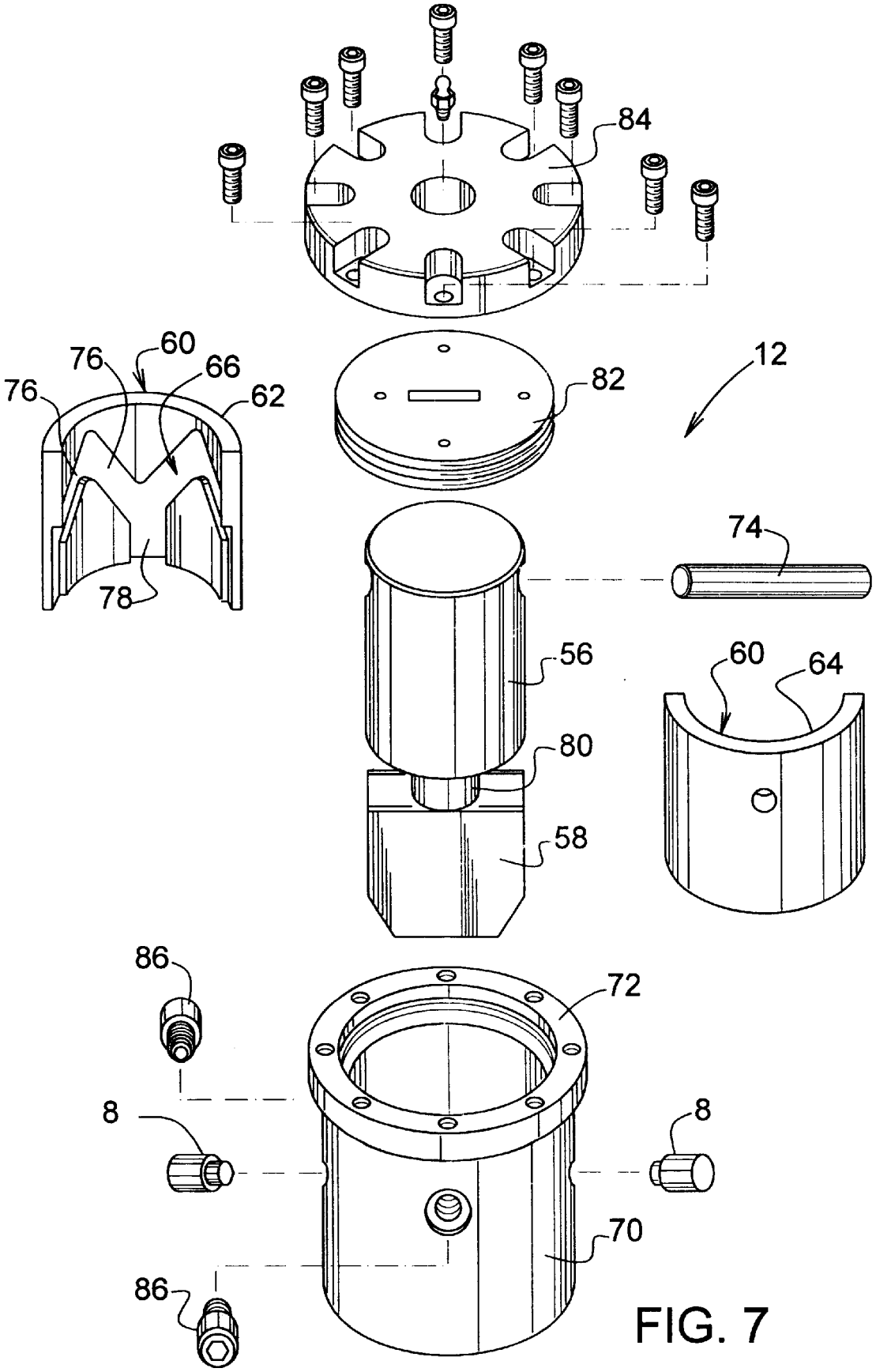
FIG. 7 is an exploded perspective view of the cylindrical cam mechanism of the present invention which also shows the travel channel of the pin within the split bushing whereby the locking dog and plunger turn in 90 degree increments locking and unlocking the lifting device.

The locking dog 56 consists of a movable cylinder coaxially disposed within a cylindrical bushing 60 which is coaxially and immovably retained within a housing 70 attached to the upper arm 42 of the lifting assembly 14. A shaft 80 extending downwardly from the locking dog 56 connects to a wedge shaped plunger 58 which extends downwardly therefrom for cooperative engagement with a slot or "keyway" 6 formed in the lower arm 44 of the lifting assembly 14. As shown in FIG. 7, the housing 70 holds the split bushings 62 and 64 into position therein. A retaining cap or "keeper" 82 threadably engages the top of the housing 70 to aid in holding the bushing 60 in position. A cover 84 is bolted to the housing 70 to distribute the weight place upon the lock and latch mechanism 14. A plurality of set screws 86 are used to align and hold the bushing 60 within the housing 70 of the upper arm 42, and locator pins 8 hold the housing 70 within the upper arm 42 as best shown in FIGS. 7 and 9.

Figure 11:
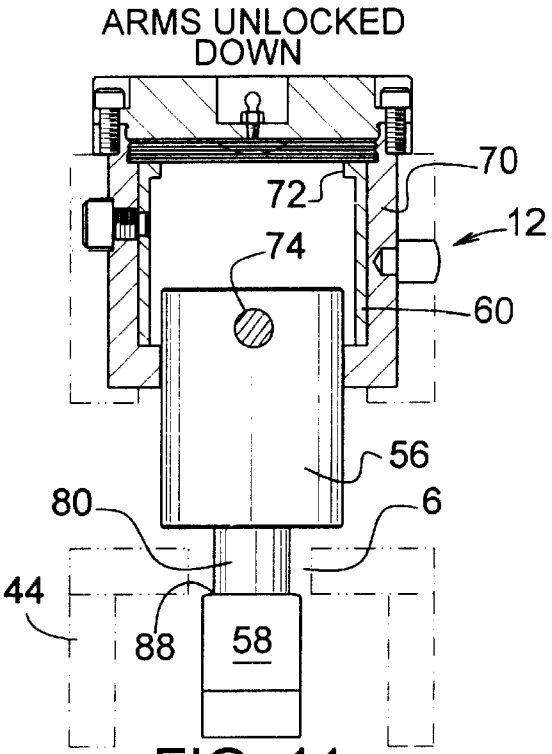
FIG. 11 is a partial cutaway perspective view of the cam locking mechanism of FIG. 7 showing the locking dog and plunger rotating to a 90 degree angle, and the pin turning at a 90 degree angle and being rotated to the down position within the bushing channel.
Figure 10:
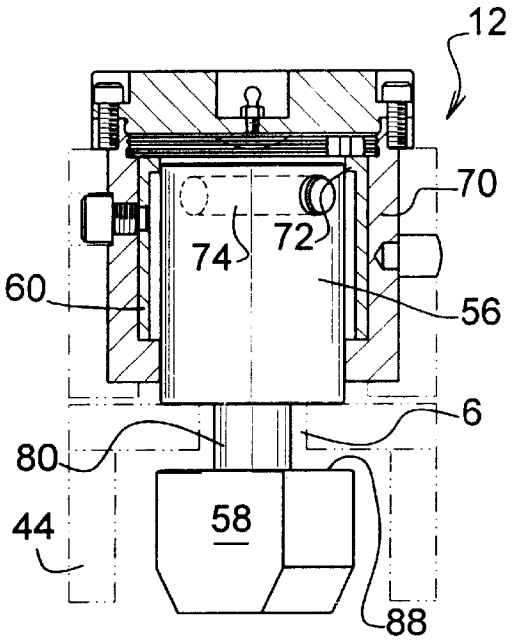
FIG. 10 is a partial cutaway perspective view of the cam locking mechanism of FIG. 7 showing the locking dog and plunger rotating to a 45 degree angle, and the pin turning at a 45 degree angle and being moved to the up position within the bushing channel.
Figure 9:
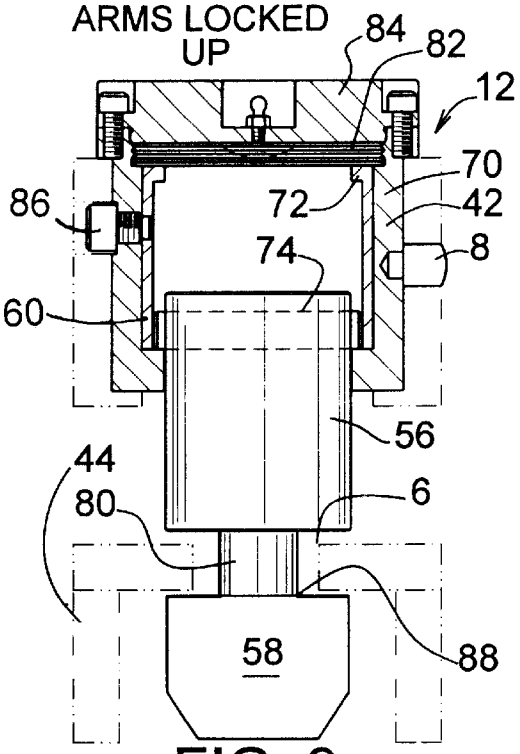
FIG. 9 is a partial cutaway perspective view of cam mechanism of FIG. 7 showing the locking dog and plunger of the cam locking mechanism in the resting position wherein the pin is at the bottom of the cam channel.
Figure 8:
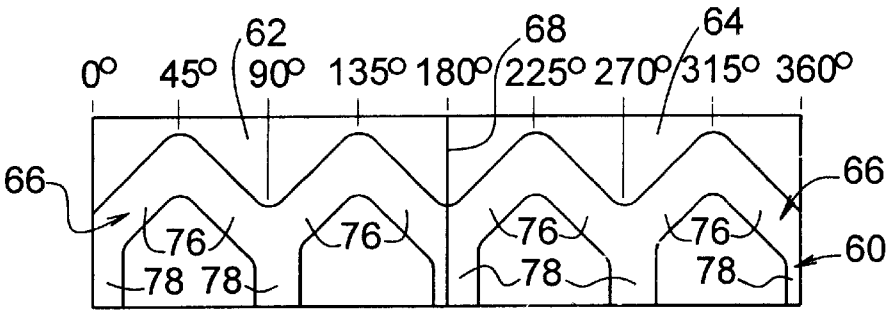
FIG. 8 is a front elevated view of the interior surface of the split cam bushing of FIG. 7 showing the channel cut into the surface which guides the pin therein producing a rotating lifting and lowering motion.

As best illustrated in FIGS. 9–11, the cylindrical cam locking mechanism 12 works as follows: With the fork lift suspending the tube bundle lifting device 10 the traveling pin 74 and locking dog 56 are in the locked "up" position so that the traveling pin 74 supporting the plunger 58 is located at the bottom of the groove 78 and the distal ends of the pin 74 are supported by the flange or channel 66 edges extending around the periphery of the split bushing 60 contained within the housing 70 of the upper arm 42. The upper surface 88 of the plunger 58 extending through the keyway 6 is oriented normal to the keyway 6 and therefor lifts the lower arm 44, lifting arms 18, and the blades 16 to a desired height at a selected position either a partially open, or a open, locked-up position, after release of a tube bundle.

Upon lowering the tube bundle lifting device 10 onto the ground the traveling pin 74 rotates an additional 45 degrees and travels downward at an angle within the channels or grooves 66 formed in the interior surface of the split bushing 60 of the cylindrical locking cam mechanism 14. The locking dog 56 and plunger 58 simultaneously extend downward and rotate an additional 45 degrees. Lifting of the tube bundle lifting device 10 with the fork lift tines takes the tension off of the traveling pin 74 and permits the rotation of the traveling pin 74 and locking dog 56 an additional 45 degrees upward to the "up" unlocked position wherein the plunger 58 is in alignment with and can extend through the keyhole 6 of the lower latch arm 44 permitting the pivoting or scissor action of the lifting arms 18 and closing of the blades 16 around an object to be lifted.

To release the tube bundle, the tube bundle lifting device 10 is lowered until the blades 16 touch the ground taking the pressure off of the travel pin 74 in the split bushing 60 of the cam locking mechanism 14. The travel pin 74 rotates and slides downwardly along the channel of the bushing 60 and the locking dog 56 rotates and additional 45 degrees. Upon lifting the tube bundle lifting device 10 upward the travel pin 74 rotates and slides upwardly along the channel 66 within the bushing 60 and the locking dog 56 and the plunger 58 again rotate 45 degrees in a locked "up" position normal to the keyway 6.

In summary, assuming the locking dog 56 is in the locked position meaning the traveling pin 74 and locking dog 56 are rotated at 45 degrees at the top of the bushing channel 66 and the locking dog 56 is in the "up" position. The next time the top frame 20 is lifted up, the traveling pin 74 and locking dog 56 will rotate and drop down 45 degrees. Upon lifting the top frame 20, the locking dog 56 will rotate and move to the top of the channel 66 at 90 degrees in misalignment with the keyhole 6 to lift the blades 16 in the opened position for moving to the next job. When the frame 20 is lowered, the travel pin 74 and locking dog 56 rotate 45 degrees which partially unlocks the locking dog 56 from the keyhole 6. The next time the frame 20 is lifted "up", the travel pin 74 and locking dog 56 rotate and drop 45 degrees aligning the unlocking dog 56 with the keyhole 6 and unlocking the dog 100 percent allowing the lifter to close around the tube bundle.

While particular embodiments of the invention have been shown and described, it should be understood that the invention is not limited thereto, since many modifications are possible within the scope of the appended claims. The foregoing detailed description is given primarily for clearness of understanding and no unnecessary limitations are to be understood therefrom, for modifications will become obvious to those skilled in the art based upon more recent disclosures and may be made without departing from the spirit of the invention and scope of the appended claims.

I claim:

1. A tube bundle lifting device, comprising:

a) a frame having at least an upper longitudinal member and at least a lower longitudinal member spaced part and in alignment with one another, said upper longitudinal member having an upper support arm extending downwardly therefrom, and said lower longitudinal member having a lower support arm extending upwardly therefrom;

b) a lifting assembly including at least two pair of opposing "J-shaped" lifting arms each one having a curved distal end and a generally straight proximal end, each pair of "J-shaped" lifting arms being pivotally attached near a center point to a distal end of said lower longitudinal member;

a pair of lifting arms each having a first distal end pivotally attaching to said upper longitudinal member and a second distal end pivotally attaching to each one of said generally straight proximal ends of said pair of "J-shaped" lifting arms;

said pair of "J-shaped" lifting arms extending downward from each end of said upper longitudinal member in alignment with one another and having opposing curved distal ends supporting a pair of curved blades thereinbetween in longitudinal alignment with said lower longitudinal member;

c) a lock and latch assembly comprising an upper latch arm having a first distal end and a second distal end and a lower latch arm having a first distal end and a second distal end, said first distal end of said upper latch arm pivotally connecting said first distal end of said lower latch arm said second distal end of said upper latch arm being pivotally attached to said upper support arm and said lower latch arm being attached to said lower support arm;

d) a lock and lift assembly having a cylindrical locking cam mechanism disposed within one of said latch arms, said cam mechanism including a cylindrical cam split bushing having a split profile at 0 and 180 degrees and grooves within its interior surface for cooperative engagement with a travel pin and locking dog disposed in cooperative communication with said grooves for rotational and up and down motion;

e) a shaped plunger extending from said cylindrical locking cam mechanism; and f) a slot formed within said lower latch arm for cooperative releasable engagement with said shaped plunger.

2. The tube bundle lifting device of claim 1, wherein said split bushing defines a first side and a second side defining a plurality of channels or grooves split along the vertical center line at 0 degrees and 180 degrees.

3. The tube bundle lifting device of claim 1, wherein said lock and lift assembly includes a housing having cylindrical sidewalls and a flange extending around a periphery of an upper end, said housing having said split bushing disposed coaxially therein, a locking dog having a hole extending therethrough in the horizontal axis and a shaped plunger extending from the bottom thereof is disposed within said split bushing whereby a pin extending through said hole of said locking dog travels in cooperative engagement with said grooves formed within said split bushing.

4. The tube bundle lifting device of claim 3, wherein said split bushing is held into position within said housing by a plurality of set screws threadedly engaging a plurality of threaded bores formed in said sidewall of said housing.

5. The tube bundle lifting device of claim 3, wherein said lock and lift assembly includes a retaining cap and means for holding said retaining cap in cooperative engagement with said housing.

6. The tube bundle lifting device of claim 5, said means for holding said retaining cap in cooperative engagement with said housing includes a plurality of threads formed around the outer periphery of said retaining cap and mating threads formed around the inner sidewall of said housing for cooperative engagement therewith.

7. The tube bundle lifting device of claim 3, including a cover having a plurality of holes extending around the periphery thereof alignable with said flange extending around said housing having threaded bores therein for cooperative engagement with a plurality of bolts extending downward and through said cover and into said threaded bores.

8. The tube bundle lifting device of claim 1, said plunger including a cylindrical neck extending from the bottom of said locking dog, said neck having a generally wedge shaped distal end extending downwardly therefrom for rotating and up and down motion, said plunger cooperatively engaging a slot or keyhole formed in the lower latch arm thereby engaging and disengaging the "J-shaped" lifting arms.

9. The tube bundle lifting device of claim 1, said locking dog and plunger turn in 90 degree increments locking and unlocking said lock and lift assembly.

10. The tube bundle lifting device of claim 1, wherein the degree of curvature of said curved blades changes slightly inwardly from the tip of said blades.

11. The tube bundle lifting device of claim 1, wherein said split bushing includes twelve grooves comprising eight top grooves in a top half interconnecting with four bottom grooves in a bottom half.

12. The tube bundle lifting device of claim 11, wherein said four bottom grooves in said bottom half are milled on the vertical center lines at the 1, 90, 180, and 270 degree lines.

13. The tube bundle lifting device of claim 11, wherein said four bottom grooves in said bottom half are milled at 0.125 thousands "off set" making said travel pin of said locking dog travel in one direction only.

14. The tube bundle lifting device of claim 11, wherein said eight top grooves are milled on a 45 degree angle intersecting said four bottom grooves allowing the locking dog to rotate a full 360 degrees with up and down motions.

15. The tube bundle lifting device of claim 14, wherein said eight top grooves are milled "off set" 0.125 thousands "off set" making said travel pin of said locking dog travel in one direction only.

* * * * *